US005863404A

United States Patent [19]

Fujimaki

[11] Patent Number: 5,863,404

[45] Date of Patent: Jan. 26, 1999

[54] FUEL CHARACTERISTICS IMPROVING DEVICE

[75] Inventor: Ryujin Fujimaki, Tokyo, Japan

[73] Assignee: AGM, Inc., Tokyo, Japan

[21] Appl. No.: 764,629

[22] Filed: Dec. 11, 1996

[30] Foreign Application Priority Data

Aug. 31, 1996 [JP] Japan ..... 8-249021

[51] Int. Cl.[6] ..... F02M 27/04

[52] U.S. Cl. ..... 204/660; 123/538; 204/664; 210/222

[58] Field of Search ..... 123/536, 538; 210/222, 243, 695, 748; 204/164, 557, 559, 660, 664

[56] References Cited

U.S. PATENT DOCUMENTS 5,124,045 6/1992 Janczak et al. ..... 210/695
5,566,661 10/1996 Zorita ..... 123/538
5,673,674 10/1997 Monteiro Vieira ..... 123/538
5,730,109 3/1998 Nozawa ..... 123/538

*Primary Examiner*—Kathryn Gorgos
*Assistant Examiner*—William T. Leader
*Attorney, Agent, or Firm*—Gary M. Nath; Nath & Associates

[57] ABSTRACT

To improve the characteristics of fuel to be used in an engine of an automotive vehicle or a boat or ship, to reduce an amount of harmful substances in emission and to enhance a fuel consumption rate, a device for improving the characteristics of fuel is provided and connected between the engine of the automotive vehicle or the boat or ship and a fuel tank. A fuel pipe spirally wound is arranged within a hexagonal housing in outer shape. A carbon rod is provided inside of the fuel pipe and a coil is wound around its outer periphery. Powder of metal, mineral and oxide is filled between the fuel pipe and the inner wall of the housing and solidified with silicone resin. The fuel flows through an interior of the fuel pipe in a spiral manner to be fed to the engine.

2 Claims, 2 Drawing Sheets

FUEL CHARACTERISTICS IMPROVING DEVICE

BACKGROUND OF THE INVENTION

1. Field of the Invention

The present invention relates to a device for improving the characteristics of fuel such as fuel oil to be supplied to an engine of a vehicle such as an automobile and a boat or ship or heavy oil or light oil to be supplied to a burner of a boiler or the like.

2. Description of the Related Art

Explanation will be made as to fuel for automobiles. Gasoline, light oil, LPG and the like are used for an automotive engine depending upon its type. It is well known that such hydrocarbonized fuel forms a variety of harmful substances through the combustion. Therefore, the amount of the harmful substances emitted after the combustion is limited by circumstance standards or legal provisions. For this reason, every car maker makes a great effort to improve engines and purifying devices such as catalyst systems to meet the applicable standards.

By the way, the demands for improving the fuel for automotive vehicles are not only decreasing the harmful substances in emission. There is a task as to how to reduce the amount of fuel to be required for running the vehicle through the same distance (i.e., fuel consumption rate). If the fuel consumption rate is enhanced, not only an economical effect is improved but also the emission of the harmful substances may be suppressed.

A technology which is noticed recently is a so-called lean-burn engine. This means that each part of the engine is improved so that a lean combustion in comparison with a conventional engine, i.e., a smooth rotation with fuel at a high air/fuel ratio may be obtained. Every car maker has researched and developed this type of engine and has provided a lean-burn engine on the market. However, the percentage of that engine on the market is still about several percent. This engine has not yet been extensively used.

It is considered that a user who thinks about purchase of an automobile would be typically worried that:

i) the power would be insufficient;

ii) Although there is no problem when the automobile is new, when it gets old, the fuel consumption rate would become worse and in addition, the power would be insufficient; and iii) the maintenance would difficult, which would increase costs for maintenance. Thus, the user hesitates to buy the automobiles with the lean-burn engine and finally decides to buy a traditional one.

Nevertheless, it is attractive that the fuel consumption rate is enhanced. Any driver wishes that. Also, although the driver could not compensate for the disadvantage of the harmful substances in emission of the automotive vehicle owned by him or her by his or her efforts, the small containment of the harmful substances in emission out of the automotive vehicle is one of the essential factors. However, if the type of the automobile is not limited as in the lean-burn engine described above but a good result is obtained by mounting a device on the automobile as desired after the purchase of the automobile, this is ideal. This is because the driver only spends a small amount of money for the vehicle that is now owned, thereby reducing the harmful substances contained in the emission and enhancing the fuel consumption rate.

SUMMARY OF THE INVENTION

In view of the foregoing aspects, an object of the present invention is to provide a device for improving the characteristics of fuel, which may readily be mounted on the current automobile and which may reduce the amount of the harmful substances in emission and enhance the fuel consumption rate.

In order to attain this and other objects, there is provided a device for improving characteristics of fuel, comprising a fuel pipe that is wound spirally and located inside a housing, said housing having a straight portion and endpieces, the straight portion extending between the endpieces and said fuel pipe protruding through the endpieces; a coil surrounding an outer periphery of a carbon rod is disposed inside of a portion of the fuel pipe wound spirally; both ends of the coil are connected to the vicinities of both the ends of the fuel pipe; and a powder of a metal, a mineral and an oxide is filled between the fuel pipe and an inner wall of the housing and is solidified with silicone resin.

The device is characterized in that winding directions of the fuel pipe and the coil are directed from a flow-in side of the fuel to a flow-out side of the fuel, two thirds of the initial portion being directed in a counterclockwise direction and the other portion being directed in a clockwise direction.

According to a first aspect of the invention, when the device for improving the characteristics of the fuel is connected between the fuel tank of the automotive vehicle and the engine thereof, gasoline or the like to be used in the engine is caused to flow through the interior of the device so that the fuel flows through the fuel pipe, a magnetic field is generated by the fuel flowing through the spiral fuel pipe. The lean-burn perfect combustion is generated.

Also, according to a second aspect of the invention, the winding directions of the fuel pipe and the coil are directed from a flow-in side of the fuel to a flow-out side of the fuel, two thirds of the initial portion being directed in a counterclockwise direction and the other portion being directed in a clockwise direction. As a result it is possible to cancel noise substances caused by an outer turbulence of induced current and to further enhance the effect.

DESCRIPTION OF THE PREFERRED EMBODIMENTS

Figure 1:
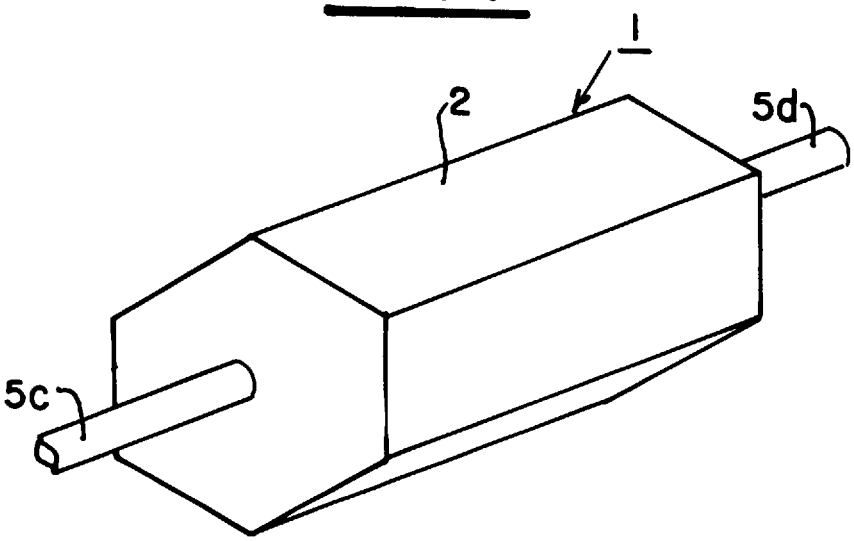
FIG. 1 is a perspective view showing an outer appearance of a device according to one embodiment of the invention.
Figure 2:
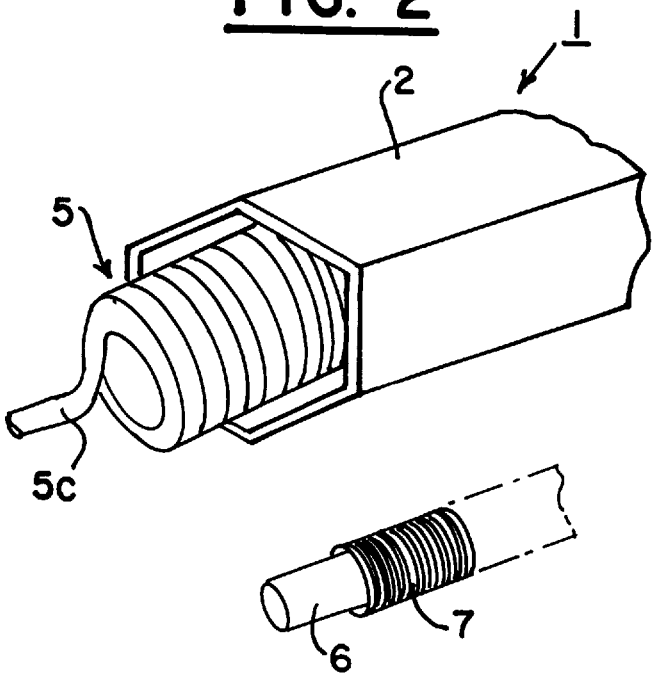
FIG. 2 is a schematic perspective view showing an internal structure of the device shown in FIG. 1.
Figure 3:
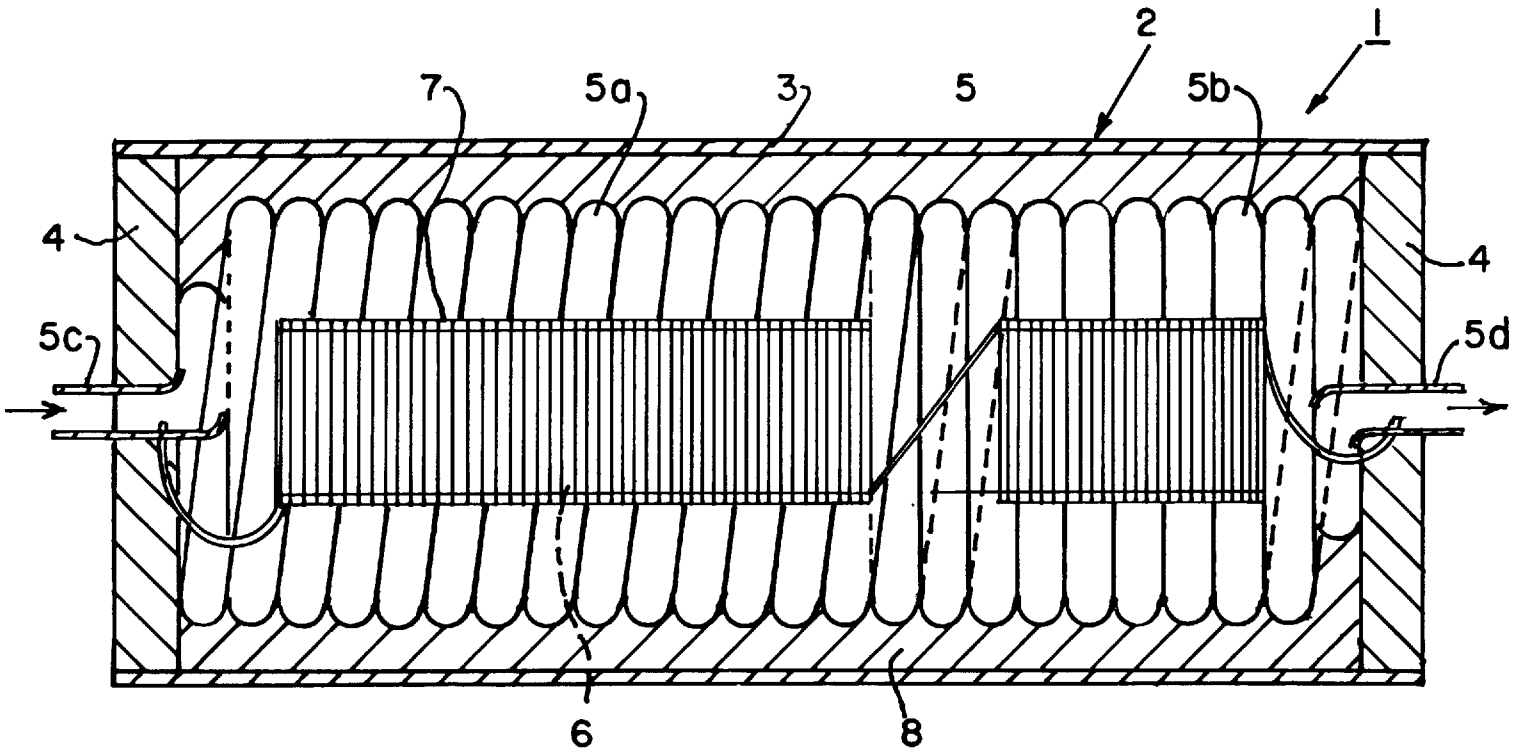
FIG. 3 is a longitudinal sectional view showing the internal structure shown in FIG. 1.

An embodiment of the present invention will now be described with reference to the accompanying drawings. In FIGS. 1 or FIG. 3, reference numeral 1 denotes a fuel characteristics improving device according to the present invention. Reference numeral 2 denotes a housing which is formed by covering both ends of a sleeve member 3 having a hexagonal outer shape by endpieces 4 and 4. A fuel pipe 5 a part of which is spirally wound (winding portions 5*a* and 5*b*) is inserted into and positioned in an interior of the housing 2. End portions 5*c* and 5*d* of the fuel pipe 5 are formed into a linear shape and protruded from the endpieces 4 and 4. One of the protruded end portion 5*c* serves as an inlet for the fuel and the other serves as an outlet for the fuel.

A carbon rod 6 and a coil 7 surrounding its outer periphery are disposed inside of the portion of the fuel pipe 5 which is wound spirally. Both ends of the coil 7 are connected to the vicinity of both ends of the fuel pipe 5. Then, powder of metal, mineral and oxide (indicated by reference numeral 8) is filled between the fuel pipe 5 and the inner wall of the housing 2 and is solidified by silicone resin. The metal, mineral and oxide used here are silicon dioxide, lead, iron oxide, quartz powder and the like.

As shown in FIG. 3, winding directions are opposite from each other at the intermediate portions of the fuel pipe 5 and the coil 7. Namely, the winding direction is counterclockwise on the fuel inlet side portion 5*a* and the winding is opposite and clockwise from the intermediate portion 5*b* onward. An S-shaped pipe is used at the change point in winding directions. The flow rate of the fuel that flows through the fuel pipe 5 is reduced at the switch point so that a stagnation time within the fuel pipe 5 is elongated. On the other hand, with respect to the coil 7, due to the opposite winding direction at the intermediate portion, it is possible to cancel electric noises from the outside.

The fuel characteristics improving device 1 thus constructed is used to be connected between a fuel tank of the automotive vehicle or a boat or ship and a fuel system of an engine thereof. Namely, in the vehicle in which the engine uses a carburetor, it is connected to a float chamber, and in case of a fuel injection type engine, it is connected before the fuel injection nozzle.

An actual example with some effects will now be described. A fuel pipe which was made of brass of 65:35 with an inner diameter of 6.5 mm and an outer diameter of 8.7 mm being wound through 14.5 turns counterclockwise and 7.5 turns clockwise for an inner winding diameter of 60 mm and an outer winding diameter of 78 mm and which was provided with an S-shape at its switch point was inserted into a fuel pipe which was made of aluminum with a thickness of 2 mm and was formed into a hexagonal shape having a side elevation dimension of 93 mm and a length dimension of 240 mm.

Carbon rods each having a diameter of 26 mm, a side elevation of 108 mm on the left side and a side elevation of 48 mm on the right side were arranged in confronted relation with each other at an interval of 24 mm. A Japanese paper having a thickness of 0.3 mm was wound by six turns in a thickness of 1.8 mm and an oil paper having a thickness of 0.2 mm was wound by six turns in a thickness of 1.2 mm around the carbon rods. The coil was wound around the assembly. The coil was formed by winding a copper wire having a diameter of 1 mm to have an inner diameter of 30 mm, 14.5 turns on the left side and 7.5 turns on the right side. It is possible to change the number of the turns of the coil depending upon a purpose if the winding number meets the above-described ratio.

The foregoing components were assembled. Powder having a total weight of 274 g and an ingredient of 19.2% of silicon dioxide, 3.4% of titanium oxide, 1.8% of germanium dioxide, 2.3% of magnesium, 3.4% of cobalt, 17.7% of lead, 1.5% of zinc, 5.6% of calcium, 10.2% of quartz powder, 2.3% of charcoal powder, and 16.5% of iron oxide was filled in the space between the fuel pipe 5 and the inner wall of the housing 2 and was solidified with silicone resin.

This was applied to a passenger car for testing. The fuel consumption rate was improved by 46%. The amount of NOx in emission was reduced down to 40%, the amount of HC was reduced down to 58% and the amount of CO was reduced down to 50%. The examiner felt that the rotation of the engine was smoother, and the intermediate torque was enhanced.

The example and the embodiment that have been described above are directed to an automotive vehicle in which gasoline is used as fuel. It is apparent that the present invention is not limited to the example and the embodiment but may be applied to any other automotive vehicles or boats or ships which use diesel engines where light oil is used as fuel or engines where LPG is used as fuel. When the invention is applied to these types of engines, it is possible to obtain an optimum effect through a suitable adjustment by suitably changing material of chemical components to be filled and amounts thereof. Also, in the embodiment, a hexagonal shape is taken as an example of a polygonal shape of the housing 2. However, the shape is not limited to that but may be other polygonal shapes such as an octagon or sometimes cylindrical shapes. Furthermore, is possible to apply the invention to a boiler in which heavy oil A or the like is used as fuel.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A device for improving characteristics of fuel comprising, a fuel pipe that is wound spirally and is located inside a housing, said housing having a straight portion and endpieces, the straight portion extending between the endpieces and said fuel pipe protruding through the endpieces; a coil surrounding an outer periphery of a carbon rod is disposed inside of a portion of the fuel pipe wound spirally; both ends of the coil are connected to the vicinities of both the ends of the fuel pipe; and a powder of a metal, a mineral and an oxide is filled between the fuel pipe and an inner wall of the housing and is solidified with silicone resin, wherein said oxide is the same as or different from said mineral.

2. The device according to claim 1, wherein winding directions of the fuel pipe and the coil are directed from a flow-in side of the fuel to a flow-out side of the fuel, two thirds of the initial portion being directed in a counterclockwise direction and the other portion being directed in a clockwise direction.

* * * * *